US006933515B2

(12) United States Patent
Hartlove et al.

(10) Patent No.: US 6,933,515 B2
(45) Date of Patent: Aug. 23, 2005

(54) LASER-PRODUCED PLASMA EUV LIGHT SOURCE WITH ISOLATED PLASMA

(75) Inventors: Jeffrey S. Hartlove, Rolling Hills Estates, CA (US); Mark E. Michaelian, Lomita, CA (US); Henry Shields, San Pedro, CA (US); Steven W. Fornaca, Torrance, CA (US); Stuart J. McNaught, O'Fallon, MO (US); Fernando Martos, Creve Coeur, MO (US); Richard H. Moyer, Chesterfield, MO (US)

(73) Assignee: University of Central Florida Research Foundation, Orlando, FL (US)

( * ) Notice: Subject to any disclaimer, the term of this patent is extended or adjusted under 35 U.S.C. 154(b) by 111 days.

(21) Appl. No.: 10/606,447

(22) Filed: Jun. 26, 2003

(65) Prior Publication Data

US 2004/0262545 A1 Dec. 30, 2004

(51) Int. Cl.[7] ..... H01J 35/00
(52) U.S. Cl. ..... 250/504 R; 378/119
(58) Field of Search ..... 250/504 R; 378/119

(56) References Cited

U.S. PATENT DOCUMENTS 5,577,092 A 11/1996 Kublak et al.
6,002,744 A 12/1999 Hertz et al.
6,324,256 B1 * 11/2001 McGregor et al. ..... 378/119

FOREIGN PATENT DOCUMENTS

SE WO 02/32197 A1 4/2002

OTHER PUBLICATIONS

Hansson, Bjorn A.M.; Rymell, Lars; Berglund, Magnus; Hemberg, Oscar; Janin, Emmanuelle; Mosesson, Sofia and Thoresen, Jalmar; "A Liquid–Xenon–Jet Laser–Plasma Source for EUV Lithography", 3rd International Workshop on EUV Lithography, 2001, 5 pps.

Wieland, M.; Wilhein, T.; Faubel, M.; Ellert, Ch.; Schmidt, M.; and Sublemontier, O.;"EUV and Fast Ion Emission from Cryogenic Liquid Jet Target Laser–Generated Plasma" Appl. Phys. B 72, 591–597 (2001)/Digital Object Identifier (DOI) 10.1007/s003400100542.

Rymell, L.; Berglund, M; Hansson, B.A.M.; and Hertz, H.M.; "X–Ray and EUV Laser–Plasma Sources Based on Cryogenic Liquid–Jet Target"; Biomedical and X–Ray Physics, Royal Institute of Technology, SE–10044 Stockholm, Sweden; Part of the SPIE Conference on Emerging Lithograph Technologies III, Santa Clara, California, Mar. 1999; pp. 421–423.

Gouge, Michael J. and Fisher, Paul W.; "A Cryogenic Xenon Droplet Generator for Use in a Compact Laser Plasma X–Ray Source"; Feb. 11, 1997; pp. 2158–2162.

Klebniczki, J; Hebling, J.; Hopp, B.; Hajos, G. and Bor, Z.; "Fluid Jet with Variable Thickness in the range 5–20 mu m"; Meas. Sci. Technol. 5 (May 1994) 601–603.

* cited by examiner

*Primary Examiner*—John R. Lee
*Assistant Examiner*—Paul M. Gurzo
(74) *Attorney, Agent, or Firm*—John A. Miller; Warn, Hoffmann, Miller & LaLone, P.C.

(57) ABSTRACT

An EUV radiation source (40) that includes a nozzle (42) positioned a far enough distance away from a target region (50) so that EUV radiation (56) generated at the target region (50) by a laser beam (54) impinging a target stream (46) emitted from the nozzle (42) is not significantly absorbed by target vapor proximate the nozzle (42). Also, the EUV radiation (56) does not significantly erode the nozzle (42) and contaminate source optics (34). In one embodiment, the nozzle (42) is more than 10 cm away from the target region (50).

11 Claims, 2 Drawing Sheets

LASER-PRODUCED PLASMA EUV LIGHT SOURCE WITH ISOLATED PLASMA

BACKGROUND OF THE INVENTION

1. Field of the Invention

This invention relates generally to an extreme ultraviolet (EUV) radiation source and, more particularly, to a laser-plasma EUV radiation source where the target area for the laser beam and the target stream are far enough from the source nozzle to provide an isolated plasma for improving the conversion of laser power to EUV radiation.

2. Discussion of the Related Art

Microelectronic integrated circuits are typically patterned on a substrate by a photolithography process, well known to those skilled in the art, where the circuit elements are defined by a light beam propagating through a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths. In other words, the resolution of the photolithography process increases as the wavelength of the light source decreases to allow smaller integrated circuit elements to be defined. The current trend for photolithography light sources is to develop a system that generates light in the extreme ultraviolet (EUV) or soft X-ray wavelengths (13–14 nm).

Various devices are known in the art to generate EUV radiation. One of the most popular EUV radiation sources is a laser-plasma, gas condensation source that uses a gas, typically xenon, as a laser plasma target material. Other gases, such as argon and krypton, and combinations of gases, are also known for the laser target material. In the known EUV radiation sources based on laser produced plasmas (LPP), the gas is typically cryogenically cooled to a liquid state, and then forced through an orifice or other nozzle opening into a vacuum process chamber as a continuous liquid stream or filament. The liquid target material rapidly evaporates and freezes in the vacuum environment to become a frozen target stream. Cryogenically cooled target materials, which are gases at room temperature, are desirable because they do not condense on the source optics, and because they produce minimal by-products that have to be evacuated by the process chamber. In some designs, the nozzle is agitated so that the target material emitted from the nozzle forms a stream of liquid droplets having a certain diameter (30–100 $\mu$m) and a predetermined droplet spacing.

The target stream is irradiated by high-power laser beam pulses, typically from an Nd:YAG laser, that heat the target material to produce a high temperature plasma which emits the EUV radiation. The pulse frequency of the laser is application specific and depends on a variety of factors. The laser beam pulses must have a certain intensity at the target area in order to provide enough heat to generate the plasma. Typical pulse durations are 5–30 ns, and a typical pulse intensity is in the range of $5\times10^{10}$–$5\times10^{12}$ W/cm$^2$.

FIG. 1 is a plan view of an EUV radiation source 10 of the type discussed above including a nozzle 12 having a target material storage chamber 14 that stores a suitable target material, such as xenon, under pressure. A heat exchanger or condenser is provided in the chamber 14 that cryogenically cools the target material to a liquid state. The liquid target material is forced through a narrowed throat portion or capillary tube 16 of the nozzle 12 to be emitted under pressure as a filament or stream 18 into a vacuum process chamber 26 towards a target area 20. The liquid target material will evaporate and quickly freeze in the vacuum environment to form a solid filament of the target material as it propagates towards the target area 20. The vacuum environment in combination with the vapor pressure of the target material will cause the frozen target material to eventually break up into frozen target fragments, depending on the distance that the stream 18 travels and other factors.

A laser beam 22 from a laser source 24 is directed towards the target area 20 in the process chamber 26 to vaporize the target material filament. The heat from the laser beam 22 causes the target material to generate a plasma 30 that radiates EUV radiation 32. The EUV radiation 32 is collected by collector optics 34 and is directed to the circuit (not shown) being patterned, or other system using the EUV radiation 32. The collector optics 34 can have any shape suitable for the purposes of collecting and directing the radiation 32, such as an elliptical dish. In this design, the laser beam 22 propagates through an opening 36 in the collector optics 34, as shown. Other designs can employ other configurations.

In an alternate design, the throat portion 16 can be vibrated by a suitable device, such as a piezoelectric vibrator, to cause the liquid target material being emitted therefrom to form a stream of droplets. The frequency of the agitation and the stream velocity determines the size and spacing of the droplets. If the target stream 18 is a series of droplets, the laser beam 22 may be pulsed to impinge every droplet, or every certain number of droplets.

As discussed above, the low temperature of the liquid target material and the low vapor pressure within the process chamber cause the target material to quickly begin freezing as it exits the nozzle exit orifice. This quick freezing tends to create an ice build-up on the outer surface of the exit orifice of the nozzle. The ice build-up interacts with the stream, causing stream instabilities, which affects the ability of the target filament to reach the target area intact and with high positional precision.

Also, filament spatial instabilities may occur as a result of freezing of the target material before radial variations in fluid velocity within the filament have relaxed, thereby causing stress-induced cracking of the frozen target filament. In other words, when the liquid target material is emitted as a liquid stream from the exit orifice, the speed of the fluid at the center of the stream is greater than the speed of the fluid at the outside of the stream. These speed variations will tend to equalize as the stream propagates. However, because the stream quickly freezes in the vacuum environment, stresses are induced within the frozen filament as a result of the velocity gradient.

The evaporating target stream 18 creates a certain steady-state pressure gradient at its location in the vacuum chamber 26. The pressure within the vacuum chamber 26 decreases the farther away from the target stream 18. Electrical discharge arcs are emitted from the plasma 30 to the conductive portions of the nozzle 12 if the gas pressure is high enough to support electrical breakdown. These arcs can travel relatively large distances and will damage the nozzle throat 16, resulting in degradation of the quality of the stream 18. If the local pressure surrounding the stream is low enough, then the electrical discharge arcs cannot be supported. Additionally, fast atoms from the plasma 30 and solid pieces of excess, unvaporized target material can impact the nozzle 12.

The electrical discharge arcs from the plasma 30 cause the nozzle material to melt or vaporize, creating nozzle damage and excess debris in the chamber. Also, the fast atoms and excess target material erode the nozzle 12. This debris also causes damage to the optical elements and other components of the source resulting in increased process costs.

It is desirable that an EUV radiation source has a good conversion efficiency. Conversion efficiency is a measure of the laser beam energy that is converted into collectable EUV radiation, i.e., watts of EUV radiation divided by watts of laser power. Xenon vapor, or other target gas vapor, emitted into the process chamber 26 as the target stream 18 freezes absorbs the EUV radiation 32 directly effecting the source conversion efficiency. For example, if the nozzle exit orifice is only a few millimeters away from the target region 20, about 30% of the EUV radiation will be absorbed. The process chamber 26 is maintained at an average pressure of a few militorr, or less, to minimize the target material vapor within the chamber, and thus, the EUV absorption losses to the target material vapor. When the target stream completely freezes, vapor no longer is emitted therefrom. Therefore, most of the EUV absorbing vapor is close to the nozzle exit orifice.

It would be desirable to move the target area 20 far enough away from the nozzle 12 so that the nozzle 12, and other source components, are not damaged by arcing and fast ions from the plasma 30. Further, by moving the target area 20 far enough away from the nozzle 12, the generated EUV radiation is not significantly absorbed by the target vapor. This provides a cost benefit because less powerful lasers would be required for the same amount of EUV radiation output, and lower vacuum pressures would be necessary. Stream instabilities need to be addressed so that the target stream accurately hits the target area 20.

SUMMARY OF THE INVENTION

In accordance with the teachings of the present invention, an EUV radiation source is disclosed that provides increased EUV conversion efficiency. The source includes a nozzle emitting a stream of a target material towards a target region, and a laser beam that impinges the target stream at the target region to generate a plasma. The nozzle is positioned a far enough distance away from the target region so that EUV radiation emitted from the plasma is not significantly absorbed by target vapor proximate the nozzle. Also, arcing from the plasma does not significantly erode the nozzle and contaminate source optics. In one embodiment, the nozzle is more than 10 cm away from the target region. In another embodiment, the nozzle emits the target stream at a slow enough speed so that the stream completely freezes before it reaches the target region.

Additional advantages and features of the present invention will become apparent from the following description and appended claims, taken in conjunction with the accompanying drawings.

DETAILED DESCRIPTION OF THE EMBODIMENTS

The following discussion of the embodiments of the invention directed to an EUV radiation source that includes a target region more that 10 cm away from a nozzle exit orifice is merely exemplary in nature, and is in no way intended to limit the invention or its applications or uses.

Figure 1:
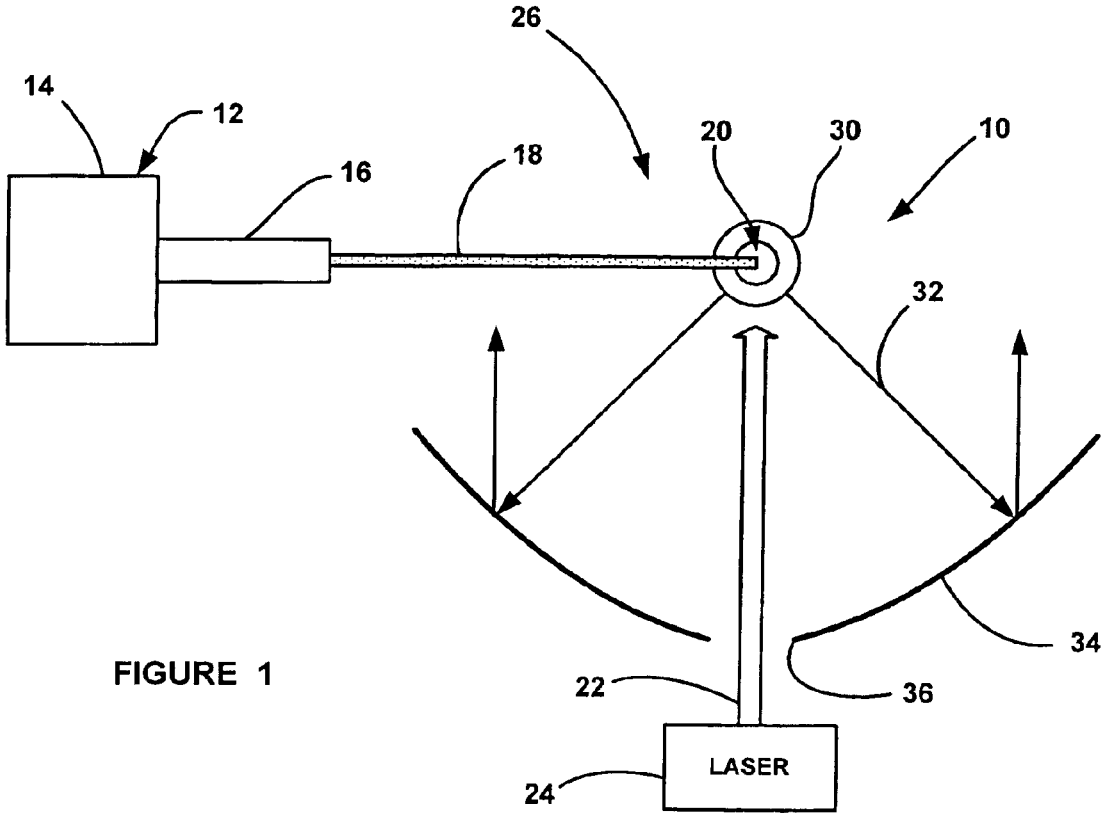
FIG. 1 is a plan view of a laser-plasma EUV radiation source.
Figure 2:
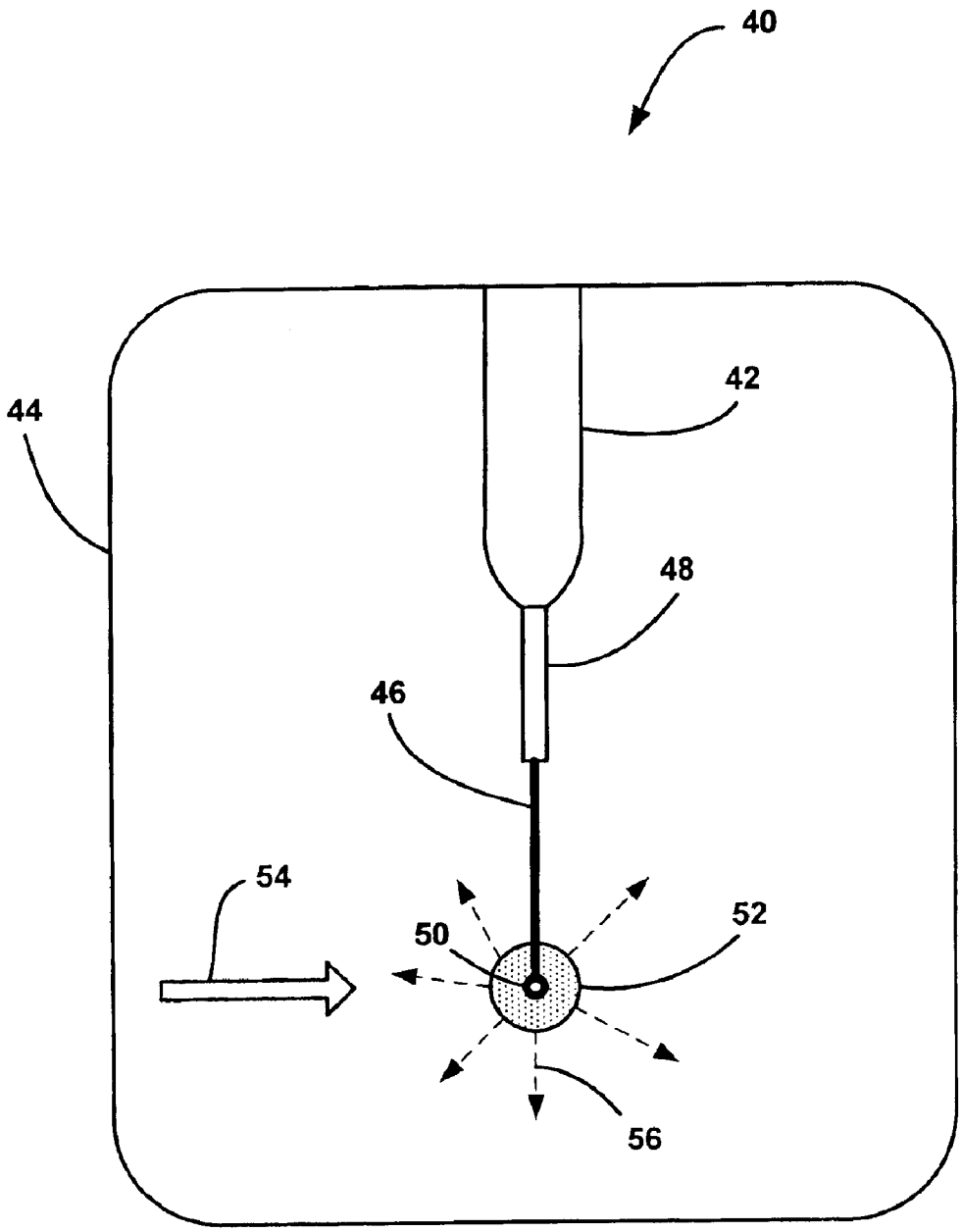
FIG. 2 is a plan view of a laser-plasma EUV radiation source where the outlet orifice of the nozzle assembly is more than 10 cm from the target region, according to an embodiment of the present invention.

FIG. 2 is a plan view of an EUV radiation source 40 of the type discussed above, according to an embodiment of the present invention. The source 40 includes a nozzle 42 extending into a vacuum process chamber 44. The nozzle 42 receives a target material, such as xenon, that is cryogenically cooled to a liquid state. In alternate embodiments, the target material can be any material suitable for the purposes described herein. The target material is emitted from a nozzle exit capillary tube 48 as a target material stream 46. The stream 46 is intended to represent any target stream suitable for an EUV radiation source, including a cylindrical filament having a certain diameter (up to 100 $\mu$m), periodically spaced target droplets having a certain diameters (up to 200 $\mu$m), a filament sheet, spaced apart cylindrical filaments, etc.

As discussed above, the target stream 46 is generally emitted from the capillary tube 48 as a liquid stream, and as a result of evaporative cooling begins to form a frozen outer shell. The target stream 46 will continue to freeze to form a completely frozen target stream. The target stream 46 and a laser beam 54 are directed towards a target interaction region 50 to generate a plasma 52, as discussed above. The plasma 52 emits EUV radiation 56 that is collected and used for a particular purpose, such as photolithography. The evaporative cooling of the target stream 46 as it freezes creates xenon vapor that locally acts to absorb the EUV radiation 56 and decrease source performance. Once the stream 46 is completely frozen, the evaporative cooling stops. Therefore, the farther the target region 50 is away from the nozzle exit orifice, the more the target stream evaporative cooling is complete at the target region 50, and the less local vapor is present to absorb the EUV radiation 56.

According to the invention, the distance from an end of the capillary tube 48 to the target region 50 is set so that the local vapor cloud is allowed to dissipate, and thus, the EUV radiation 56 is not significantly absorbed by the evaporating gas. In one embodiment, this distance is at or greater than 10 cm. However, this is by way of a non-limiting example in that different sources may employ different distances. For example, by making the distance between the end of the capillary tube 48 and the target region 50 about 180 mm, none of the EUV radiation 56 is absorbed by the vapor cloud.

Additionally, because the plasma 52 is relatively far away from the nozzle 42, arcing between the plasma 52 and the nozzle 42 does not occur which would otherwise cause sputtering that could damage the nozzle 42 and contaminate collector optics within the source 40. Thus, the lives of the nozzle and the collector optics are preserved.

The emission of the target stream 46 from the nozzle 42 is tightly controlled so that the stream 46 accurately intersects the laser beam 54 at the target region 50. The temperature and pressure of the xenon in the nozzle 42, and the local gas pressure at the nozzle exit orifice, are controlled to the tolerances necessary for a stable target stream.

In an alternative embodiment, the nozzle 42 forces the stream 46 out of the capillary tube 48 at a relatively slow speed so that the target stream 46 has more time to freeze before it reaches the target region 50. Thus, because the target stream 46 is frozen at the target region 50, there is no evaporating gas near the target region 50 as a result of evaporative cooling. In one embodiment, the target stream 46 has a speed of about 10 millimeters per second.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An extreme ultraviolet (EUV) radiation source for generating EUV radiation, said source comprising:

a source nozzle for emitting a target material stream to a target area, said nozzle including an exit orifice through which the target material stream is emitted; and a laser source generating a laser beam, said laser beam impinging the target material stream at the target area to create a plasma that emits the EUV radiation, wherein the exit orifice of the source nozzle is at or greater than 10 cm away from the target area.

2. The source according to claim 1 wherein the exit orifice of the source nozzle is about 180 mm away from the target area.

3. The source according to claim 1 wherein the source nozzle includes a capillary tube through which the target material stream is emitted.

4. The source according to claim 1 wherein the target material stream is emitted from the source nozzle as a liquid stream, and wherein the target material stream effectively freezes before it reaches the target area.

5. The source according to claim 1 wherein the target material stream is selected from the group consisting of a cylindrical filament, a plurality of spaced apart cylindrical filaments, a stream of droplets and a target sheet.

6. The source according to claim 1 wherein the target material is xenon.

7. An extreme ultraviolet (EUV) radiation source for generating EUV radiation, said source comprising:

a source nozzle for emitting a target material stream to a target area, said nozzle including an exit orifice through which the target material stream is emitted, said target stream traveling slow enough so that it is completely frozen when it reaches the target area, wherein the stream travels about 10 millimeters per second; and a laser source generating a laser beam, said laser beam impinging the target material stream at the target area to create a plasma that emits the EUV radiation.

8. A method for generating EUV radiation, said method comprising:

emitting a target material stream from a source nozzle to a target area in a vacuum chamber; and impinging the target material stream at the target area with a laser beam to create a plasma that emits the EUV radiation, wherein the target material stream travels a far enough distance from the source nozzle to the target area so that the EUV radiation is not significantly absorbed by target vapor proximate the source nozzle, wherein the target material stream travels farther than 10 cm from the source nozzle to the target area.

9. The method according to claim 8 wherein the target material stream travels about 180 mm from the source nozzle to the target area.

10. The method according to claim 8 wherein the target material stream is emitted from the source nozzle as a liquid stream, and wherein the target material completely freezes before it reaches the target area.

11. The method according to claim 8 wherein the target material stream is selected from the group consisting of a cylindrical filament, a plurality of spaced apart cylindrical filaments, a stream of droplets and a target sheet.

* * * * *